US011643240B2

(12) United States Patent
Bevier

(10) Patent No.: US 11,643,240 B2
(45) Date of Patent: May 9, 2023

(54) CONTAINER WITH IMPROVED BREAKDOWN FEATURES

(71) Applicant: INTERNATIONAL PAPER COMPANY, Memphis, TN (US)

(72) Inventor: Alex Dean Bevier, Fresno, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 784 days.

(21) Appl. No.: 16/594,701

(22) Filed: Oct. 7, 2019

(65) Prior Publication Data

US 2021/0101713 A1 Apr. 8, 2021

(51) Int. Cl.
*B65D 5/36* (2006.01)
*B65D 5/20* (2006.01)
*B65D 5/42* (2006.01)

(52) U.S. Cl.
CPC ..... *B65D 5/3678* (2013.01); *B65D 5/2052* (2013.01); *B65D 5/4279* (2013.01)

(58) Field of Classification Search
CPC .. B65D 5/3678; B65D 5/2052; B65D 5/4279; B65D 5/3635; B65D 5/4266; B65D 5/36; B65D 5/3621
USPC ..... 229/117.01, 117.03; 206/600
See application file for complete search history.

(56) References Cited

U.S. PATENT DOCUMENTS 1,652,844 A 12/1927 Wormer
3,119,547 A * 1/1964 Nute ..... B65D 5/3628 229/117.06
3,181,772 A 5/1965 Collins et al.
3,199,762 A * 8/1965 Coons ..... B65D 5/48014 229/117.06
3,638,852 A 2/1972 Solanka
4,331,234 A 5/1982 Gilbert
5,183,200 A 2/1993 Okamoto
5,209,392 A 5/1993 Anatro
5,301,872 A 4/1994 Tusing et al.
5,375,761 A 12/1994 Sullivan et al.
6,109,513 A 8/2000 Dugan
8,448,843 B2 5/2013 Bettinger et al.
(Continued)

FOREIGN PATENT DOCUMENTS

CN 204642408 9/2015
GB 2484127 A 4/2009
(Continued)

*Primary Examiner* — Christopher R Demeree
(74) *Attorney, Agent, or Firm* — Michael J. Folkerts; Thomas W. Ryan

(57) ABSTRACT

A corrugated cardboard blank for making a collapsible container including one or more panels joined to a bottom panel. The bottom panel is divided into first and second sectional panels on opposing sides of an interface comprising perforated portions extending from a first pair of diagonally opposing corners of the bottom panel. Each perforated portion includes an inner end, wherein the inner ends of the perforated portions are longitudinally spaced from each other. First and second fold lines extend diagonally at least partially between a second pair of diagonally opposing corners of the bottom panel and respective perforated portions. A frangible central portion of the interface extends between the inner ends of the perforated portions, wherein a plurality of unbroken flutes of the corrugated material extend laterally across the central portion of the interface.

6 Claims, 8 Drawing Sheets

(56) References Cited

U.S. PATENT DOCUMENTS

| | | | | |
|---|---|---|---|---|
| 8,881,969 | B1 | 11/2014 | Prins | |
| 8,960,527 | B2 | 2/2015 | Hui | |
| 10,118,725 | B2 * | 11/2018 | Al-Housseiny ..... | B65D 5/36 |
| 2003/0234284 | A1 | 12/2003 | Chiera et al. | |
| 2010/0006629 | A1 | 1/2010 | Bettinger et al. | |
| 2013/0026215 | A1 * | 1/2013 | Lenhard ..... | B65D 5/18<br>229/126 |
| 2014/0158752 | A1 | 1/2014 | Lopez et al. | |
| 2014/0191022 | A1 | 7/2014 | Volz et al. | |
| 2014/0241304 | A1 | 8/2014 | Bevier | |

FOREIGN PATENT DOCUMENTS

| | | | |
|---|---|---|---|
| JP | S6010714-4 | U | 1/1985 |
| JP | 19970349285 | | 12/1997 |
| JP | 10297626 | | 11/1998 |
| JP | 2010030614 | | 2/2010 |
| JP | 2011246144 | | 12/2010 |
| WO | WO-2009/127703 | A1 | 10/2009 |

* cited by examiner

CONTAINER WITH IMPROVED BREAKDOWN FEATURES

FIELD OF THE INVENTION

The present disclosure relates to containers or trays formed from a blank of material and, more particularly, to a container that is formed with a breakdown feature that resists operation of the breakdown feature until a user initiates a breakdown operation.

BACKGROUND OF THE INVENTION

In some applications of containers or trays formed of folded material such as paperboard material, e.g., corrugated paperboard, the container or tray may include end walls and/or side walls formed of two or more layers of material. For example, the container may be structured to increase stacking strength, so as to resist collapse of vertical end and side walls when plural containers are stacked, wherein the end and side walls may be formed integrally with a bottom panel of the container to provide a generally rigid container that is resistant to distortion or collapse in both the vertical and horizontal directions. While the described containers are effective to maintain their shape for protecting a product during use, such as during transport of the container and associated product, it is difficult to collapse such containers following use so as to provide a flattened configuration for plural containers to be compactly stacked for storage and/or disposal.

Various solutions have been proposed for enabling containers to be readily collapsed following use of the container, including forming weakened portions in the bottom panel of the container that can permit the bottom panel to break and enabling the parallelepiped structure formed by the end and side walls to be folded to a flattened configuration. For example, U.S. Pat. No. 3,638,852 discloses a container comprising a bottom panel that includes a cut line extending between diagonally opposite corners, wherein opposing edges of the cut line are connected by uncut material defining a pair of holding tabs or webs. Fold lines extend from and bisect the remaining two corners and extend to the cut line. The webs of uncut material can be broken and the bottom panel can be folded about the fold lines to collapse the box. It is believed that the cut line may provide a weakened area of the bottom panel that may permit portions of the bottom panel adjacent to the cut line to flex, such as in response to a force applied transverse to the plane of the bottom panel, that could result in premature breakage of the webs of uncut material during use of the container. Further, preformed weakened areas along the bottom panel of containers can permit the bottom of the container to sag under the weight of the contents of the container. Hence, there is a need for a container configuration that includes one or more release features that can facilitate collapse of the container following use of the container, and that can minimize sag of the container bottom as well as limit operation of the release features without direct manipulation by a user.

SUMMARY OF THE INVENTION

In accordance with an aspect of the invention, a blank comprising corrugated cardboard including a layer defined by elongated flutes for making a collapsible container is provided. The blank comprises a bottom panel having opposing first and second longitudinal edges and opposing first and second lateral edges transverse to the longitudinal edges. One or more panels are hingedly joined to the bottom panel at one or more of the longitudinal and lateral edges. The bottom panel is divided into first and second sectional panels on opposing sides of an interface comprising perforated portions generally aligned with a diagonal between a first pair of diagonally opposing corners of the bottom panel. Each perforated portion includes an inner end, wherein the inner ends of the perforated portions are longitudinally spaced from each other. First and second fold lines extend diagonally at least partially between a second pair of diagonally opposing corners of the bottom panel and respective perforated portions. A frangible central portion of the interface extends between the inner ends of the perforated portions, wherein a plurality of unbroken flutes of the corrugated material extend laterally across the central portion of the interface.

The plurality of unbroken flutes may comprise an area that extends substantially an entire longitudinal length of the central portion of the interface between the inner ends of the perforated portions.

The first and second fold lines may each include opposing ends spaced from the corners of the bottom panel and from the perforated portions by respective sections of unbroken flutes.

The central portion of the interface may extend generally parallel to the first and second lateral edges.

The perforated portions may comprise first and second curved perforated portions.

The first and second curved perforated portions may be concavely curved in opposite directions relative to a diagonal line extending between the first pair of diagonally opposing corners.

The first and second curved perforated portions may include an outer end that terminates spaced from a respective one of the first pair of diagonally opposing corners, and may include a connecting section extending between each of the first pair of diagonally opposing corners and an outer end of a respective curved perforated portion, the connecting sections may have a different tear resistance than the first and second curved perforated portions.

The connecting sections may define perforated sections.

The connecting sections may be substantially straight relative to the respective first and second curved perforated portions.

The central portion of the interface may include at least one release tab.

The at least one release tab may comprise first and second release tabs integrally attached to the first and second sectional panels, respectively, wherein the first release tab may be defined in the second sectional panel and the second release tab may be defined in the first sectional panel.

The frangible central portion of the interface may be defined by a tear strip connected to the at least one release tab and extending longitudinally between the inner ends of the perforated portions, and the plurality of unbroken flutes may extend laterally across the tear strip along a longitudinal length of the tear strip.

In accordance with another aspect of the invention, a blank for making a collapsible container is provided. The blank comprises a bottom panel having opposing first and second longitudinal edges and opposing first and second lateral edges transverse to the longitudinal edges. One or more panels are hingedly joined to the bottom panel at one or more of the longitudinal and lateral edges. The bottom panel is divided into first and second sectional panels on opposing sides of an interface comprising perforated portions generally aligned with a diagonal between a first pair of diagonally opposing corners of the bottom panel. Each perforated portion includes an inner end, wherein the inner ends of the perforated portions are longitudinally spaced from each other. First and second fold lines extend diagonally at least partially between a second pair of diagonally opposing corners of the bottom panel and respective perforated portions. First and second release tabs are formed integrally with the first and second sectional panels, respectively, wherein the first release tab is defined in the second sectional panel and the second release tab is defined in the first sectional panel.

The first and second release tabs may be located adjacent to each other between the inner ends of the perforated portions, and are located on opposing sides of the interface.

At least a portion of the first and second release tabs may overlap in a longitudinal direction of extension of the interface.

The first release tab may be releasably connected to the second sectional panel at a first perforated portion located distal from the interface, and the second release tab may be releasably connected to the first sectional panel at a second perforated portion located distal from the interface.

The blank may comprise corrugated cardboard including a layer defined by elongated flutes, and may include a plurality of unbroken flutes extending laterally in the first and second release tabs across the interface.

The perforated portions may comprise first and second curved perforated portions that may be concavely curved in opposite directions relative to a diagonal line extending between the first pair of diagonally opposing corners.

The first and second curved perforated portions may include an outer end that terminates spaced from a respective one of the first pair of diagonally opposing corners, and may include a connecting perforated section extending between each of the first pair of diagonally opposing corners and an outer end of a respective curved perforated portion.

In accordance with a further aspect of the invention, a collapsible container formed from a blank comprising corrugated cardboard including a layer defined by elongated flutes is provided. The blank further including a bottom panel having opposing first and second longitudinal edges and opposing first and second lateral edges transverse to the longitudinal edges, and one or more panels hingedly joined to the bottom panel at one or more of the longitudinal and lateral edges. The container comprises opposing end panels extending perpendicular from the longitudinal edges of the bottom panel, and side panels extending perpendicular from the lateral edges of the bottom panel and hingedly joined to the end panels. The bottom panel comprises first and second sectional panels on opposing sides of an interface comprising perforated portions generally aligned with a diagonal between a first pair of diagonally opposing corners of the bottom panel, each perforated portion including an inner end, wherein the inner ends of the perforated portions are longitudinally spaced from each other. First and second fold lines extend diagonally at least partially between a second pair of diagonally opposing corners of the bottom panel and respective perforated portions. A frangible central portion of the interface extends between the inner ends of the perforated portions, wherein a plurality of unbroken flutes of the corrugated material extend laterally across the central portion of the interface.

The plurality of unbroken flutes may comprise an area that extends substantially an entire longitudinal length of the central portion of the interface between the inner ends of the perforated portions.

The first and second fold lines may each include opposing ends spaced from the corners of the bottom panel and from the perforated portions by respective sections of unbroken flutes.

The perforated portions may comprise first and second curved perforated portions that are concavely curved in opposite directions relative to a diagonal line extending between the first pair of diagonally opposing corners.

At least one release tab may be provided displaceable out of the bottom panel to initiate a separation of the first and second sectional panels at the interface, followed by folding the first and second sectional panels about the respective first and second fold lines to collapse the side panels and end panels to a substantially flat configuration.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
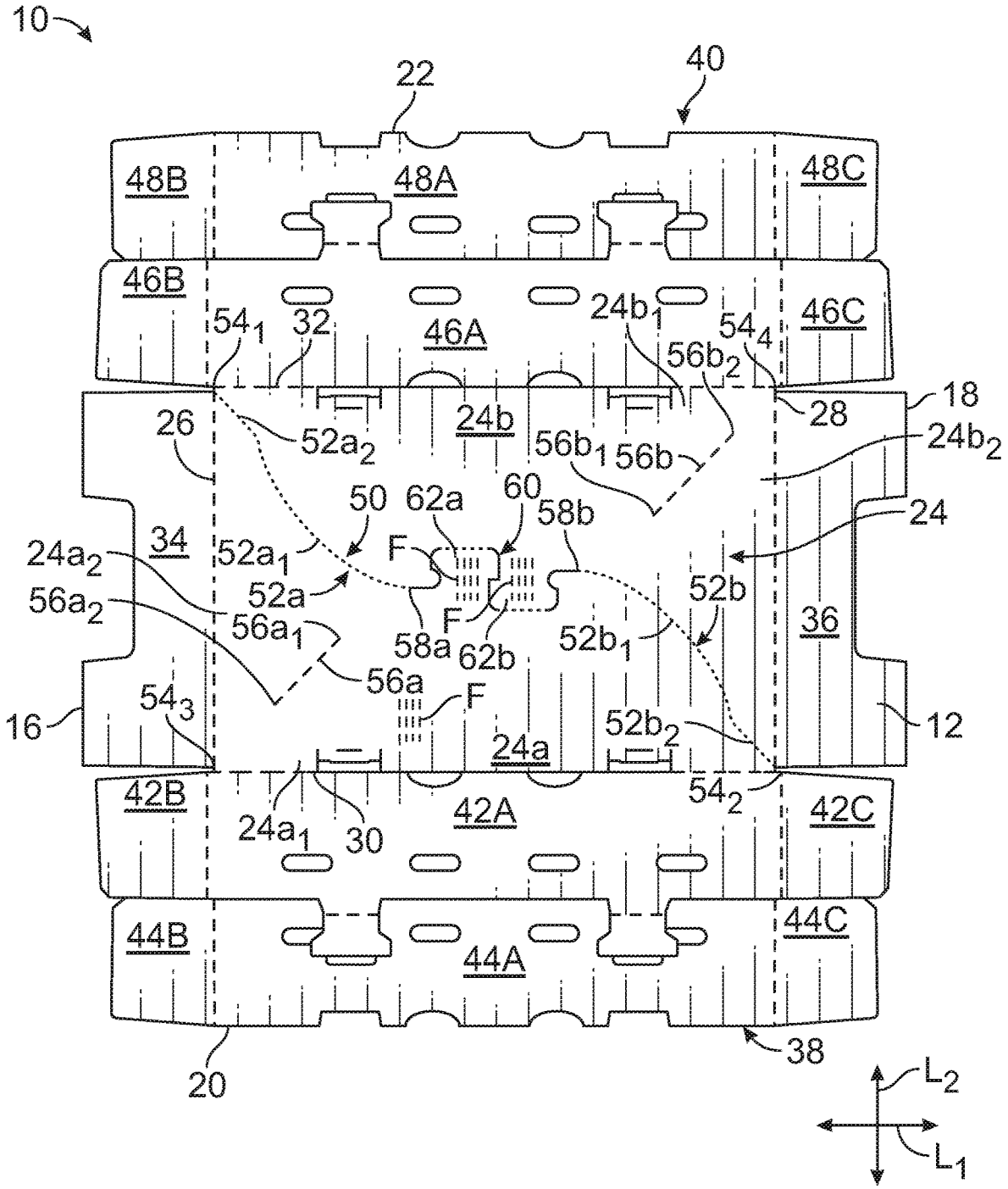
FIG. 1 is a plan view of a blank illustrating a breakdown feature for collapsing a container.

Referring to FIG. 1, a die cut blank 10 is shown for illustrating one or more aspects of a container or tray comprising breakdown features for facilitating converting a container or tray from an erected configuration to a collapsed configuration, as described herein. The particular blank 10 illustrated herein can be used to form a tray 8, see FIG. 3. However, it should be understood that the present description is not limited to the particular form of container described herein, wherein the described breakdown features can be incorporated in other forms of containers including, but not limited to, bliss containers or other containers configured to be resistant to collapse.

The blank 10 may be formed of a corrugated cardboard material having an interior portion or layer defined by elongated flutes, generally designated F in FIG. 1, as is generally known in the art, and may be die cut to the shape shown herein, although other materials and variations of the illustrated shape may be provided within the scope of the blank and container described herein. The blank 10 illustrated in FIG. 1 is a planar piece of material in which an outer side 12 is shown facing out of the page and an inner side 14, see FIG. 2, faces in an opposite direction from the outer side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral edges, generally designated 20 and 22, respectively. It may be noted that the flutes F extend in the lateral direction $L_2$.

The blank 10 comprises a bottom panel 24 having a generally rectangular shape including opposing longitudinal edges 26, 28, and opposing lateral edges 30, 32. First and second end wall panels 34, 36 are hingedly connected to the respective longitudinal edges 26, 28, and first and second side walls 38, 40 are connected to the respective lateral edges 30, 32. The first side wall 38 comprises an outer side panel 42A hingedly connected to the lateral edge 30 and an inner side panel 44A hingedly connected to the outer side panel 42A. Similarly, the second side wall 40 comprises an outer side panel 46A hingedly connected to the lateral edge 32 and an inner side panel 48A hingedly connected to the outer side panel 46A. Minor outer end flaps 42B, 42C and 46B, 46C are hingedly attached to respective outer side panels 42*a* and 46A, and minor inner end flaps 44B, 44C and 48B, 48C are hingedly attached to respective inner side panels 44A and 48A.

The bottom panel 24 is formed with features that facilitate reconfiguring an erected tray 8 formed from the blank 10 into a collapsed configuration. As seen in FIG. 1, the bottom panel 24 is divided into first and second sectional panels 24*a*, 24*b* on opposing sides of an interface 50 comprising first and second perforated portions 52*a*, 52*b* generally diagonally aligned with, or at least partially defining, a diagonal, i.e., a diagonal line, across the bottom panel 24 between a first pair of diagonally opposing first and second corners $\mathbf{54}_1$, $\mathbf{54}_2$ of the bottom panel 24. The perforated portions 52*a*, 52*b* include respective first and second inner ends 58*a*, 58*b* that are longitudinally spaced apart and define opposing longitudinal ends of a central portion 60 of the interface 50.

First and second fold lines 56*a*, 56*b* are generally diagonally aligned with a line across the bottom panel 24 between a second pair of diagonally opposing third and fourth corners $\mathbf{54}_3$, $\mathbf{54}_4$ of the bottom panel 24, and can extend generally diagonally across the bottom panel 24 at least partially between a second pair of diagonally opposing third and fourth corners $\mathbf{54}_3$, $\mathbf{54}_4$ of the bottom panel 24 and respective perforated portions 52*a*, 52*b*. In particular, the first fold line 56*a* includes an inner end $\mathbf{56}a_1$ that is spaced from the first perforated portion 52*a*, and includes an outer end $\mathbf{56}a_2$ that is spaced from the third corner $\mathbf{54}_3$. Similarly, the second fold line 56*b* includes an inner end $\mathbf{56}b_1$ that is spaced from the second perforated portion 52*b*, and includes an outer end $\mathbf{56}b_2$ that is spaced from the fourth corner $\mathbf{54}_4$. The first and second fold lines 56*a*, 56*b* can be defined by respective score lines formed in the material of the bottom panel 24 and forming non-separable, foldable connections between adjacent portions $\mathbf{24}a_1$, $\mathbf{24}a_2$ and $\mathbf{24}b_1$, $\mathbf{24}b_2$ of the first and second sectional panels 24*a*, 24*b*.

It should be noted that areas in the bottom panel 24 defined between the ends of the fold lines 56*a*, 56*b* and the respective perforated portions 52*a*, 52*b* and corners $\mathbf{54}_3$, $\mathbf{54}_4$ comprise areas of the bottom panel 24 with unbroken flutes F, i.e., uncrushed and/or uncut flutes, that can facilitate maintaining the strength of the bottom panel 24 to resist sagging during use of the container 8.

Figure 1A:
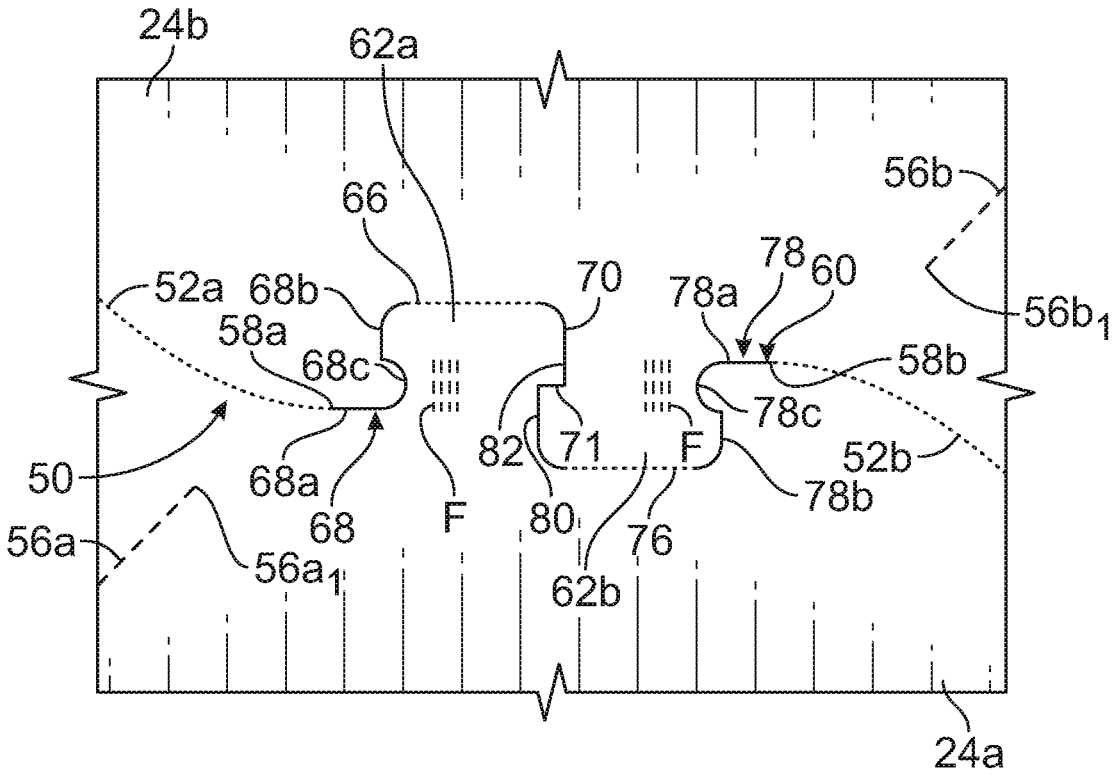
FIG. 1A is an enlarged view of the breakdown feature illustrated in FIG. 1.

Referring further to FIG. 1A, the interface 50 includes a frangible central portion 60 of the interface 50 located between the first and second inner ends 58*a*, 58*b*, wherein the frangible central portion 60 can include at least one release tab. As illustrated in FIG. 1A, the central portion 60 extends generally parallel to the lateral edges 20, 22 and includes first and second release tabs 62*a*, 62*b* located adjacent to each other on opposing sides of the interface 50. The first and second release tabs 62*a*, 62*b* are formed integrally with the first and second sectional panels 24*a*, 24*b*, respectively, wherein the first release tab 62*a* is defined in the second sectional panel 24*b* and the second release tab 62*b* is defined in the first sectional panel 24*a*. In particular, the first release tab 62*a* is integrally connected to the first sectional panel 24*a* and includes an outer tab edge 66 defined by a perforated portion that detachably attaches the first tab 66 to the second sectional panel 24*b*.

A continuous slit 68 extends from a location adjacent to the first inner end 58*a* to the outer tab edge 66 to define a side of the first release tab 62*a*. A central portion 68*c* of the slit 68 may be curved and is connected to a first straight portion 68*a* and a first tab side 68*b* at either end of the central portion 68*c*. The first tab side 68*b* extends from the central portion 68*c* to the outer tab edge 66 of the first release tab 62*a*, generally perpendicular to the first straight portion 68*a* and generally perpendicular to the central portion 60 of the interface 50. A second tab side 70 is defined by a slit that extends generally parallel to the first tab side 68*b* from the outer tab edge 66 of the first release tab 62*a* toward the interface 50.

The second release tab 62*b* is integrally connected to the second sectional panel 24*b* and includes an outer tab edge 76 defined by a perforated portion that detachably attaches the second release tab 62*b* to the first sectional panel 24*a*. A continuous slit 78 extends from a location adjacent to the second inner end 58*b* to the outer tab edge 76 to define a side of the second release tab 62*b*. A central portion 78*c* of the slit 78 is curved and is connected to a second straight portion 78*a* and a first tab side 78*b* at either end of the central portion 78*c*. The first tab side 78*b* extends from the central portion 78*c* to the outer tab edge 76 of the second release tab 62*b*, generally perpendicular to the second straight portion 78*a* and generally perpendicular to the central portion 60 of the interface 50.

A second tab side 80 is defined by a slit that extends generally parallel to the first tab side 78*b* from the outer tab edge 76 of the second release tab 62*b* toward the interface at a longitudinal location aligned with a portion of the first release tab 62*a*. Further, the second tab side 70 of the first release tab 62*a* is longitudinally aligned with a portion of the second release tab 62*b*. Hence, the first and second release tabs 62*a*, 62*b* overlap each other in the longitudinal direction $L_1$, i.e., in the direction of elongation of the central portion 60 of the interface 50. The first and second release tabs 62*a*, 62*b* may adjoin each other along a short lateral slit 71 that is laterally aligned along the interface 50. The described slits form the first and second release tabs 62*a*, 62*b* as generally T-shaped members.

It may be understood that the release tabs 62*a*, 62*b* define a frangible central portion 60 of the interface 50 extending between the inner ends 58*a*, 58*b* of the perforated portions 52*a*, 52*b*. Further, a plurality of unbroken flutes F of the corrugated material extend laterally across the central portion 60 of the interface 50, wherein the plurality of unbroken flutes F comprises an area that extends substantially an entire longitudinal length of the central portion 60 of the interface 50 between the inner ends 58*a*, 58*b* of the perforated portions 52*a*, 52*b*, see FIG. 1A. The present configuration for the blank 10, comprising a plurality of unbroken flutes F, i.e., uncrushed and uncut flutes, that extend laterally from the first and second sectional panels 24*a*, 24*b*, across the interface 50, through the respective first and second release tabs 62*a*, 62*b*, can facilitate maintaining strength in the bottom panel 24 to resist sagging at the interface 50 as well as resist premature separation of the sectional panels 24*a*, 24*b* at the interface 50.

Referring to FIG. 1, the first and second perforated portions 52*a*, 52*b* are configured with further features that can increase resistance to separation of the interface 50 between the first and second inner ends 58*a*, 58*b* and the respective corners $\mathbf{54}_4$, $\mathbf{54}_3$. The first perforated portion 52*a* comprises a curved, first section $\mathbf{52}a_1$, defining a first curved portion, extending from the first inner end 58*a*, and a second section $\mathbf{52}a_2$ extending from the first section $\mathbf{52}a_1$ to the first corner $\mathbf{54}_1$, wherein the second section $\mathbf{52}a_2$ may have a different configuration from the first section $\mathbf{52}a_1$ and can be substantially straight relative to the first section $\mathbf{52}a_1$. For example, the second section $\mathbf{52}a_2$ can be defined by a straight line, a substantially straight line, or a curve, such as a curve having a direction of concavity opposite from the first section first section $\mathbf{52}a_1$. In some configurations, the second section $\mathbf{52}a_2$ can comprise a perforated section. The second section $\mathbf{52}a_2$ can bisect or generally bisect the first corner $\mathbf{54}_1$ and can include perforations that are larger than the perforations of the first section $\mathbf{52}a_1$ to facilitate separation of the sectional panels 24*a*, 24*b* as separation progresses from the first section $\mathbf{52}a_1$ to the second section $\mathbf{52}a_2$.

The second perforated portion 52*b* comprises a curved, first section $\mathbf{52}b_1$, defining a second curved portion, extending from the second inner end 58*b*, and a second section $\mathbf{52}b_2$ extending from the first section $\mathbf{52}b_1$ to the second corner $\mathbf{54}_2$, wherein the second section $\mathbf{52}b_2$ may have a different configuration from the first section $\mathbf{52}b_1$ and can be substantially straight relative to the first section $\mathbf{52}b_1$. For example, the second section $\mathbf{52}b_2$ can be defined by a straight line, a substantially straight line, or a curve, such as a curve having a direction of concavity opposite from the first section $\mathbf{52}b_1$. In some configurations, the second section $\mathbf{52}b_2$ can comprise a perforated section. The second section $\mathbf{52}b_2$ can bisect or generally bisect the second corner $\mathbf{54}_2$ and can include perforations that are larger than the perforations of the first section $\mathbf{52}b_1$ to facilitate separation of the sectional panels 24*a*, 24*b* as separation progresses from the first section $\mathbf{52}a_1$ to the second section $\mathbf{52}a_2$.

The first and second curved portions $\mathbf{52}a_1$, $\mathbf{52}b_1$ are concavely curved in opposite directions relative to a diagonal line (not shown) extending between the first pair of diagonally opposing corners, i.e., between the first corner $\mathbf{54}_1$ and the second corner $\mathbf{54}_2$. In particular, the first and second curved portions $\mathbf{52}a_1$ and $\mathbf{52}b_1$ are concavely curved toward the respective lateral edges 22, 20. The oppositely curved portions $\mathbf{52}a_1$ and $\mathbf{52}b_1$ form an opposite warp to the bottom panel 24, such that the bottom panel 24 tends to bend or warp in opposite directions in the areas adjacent to the curved portions $\mathbf{52}a_1$ and $\mathbf{52}b_1$. It is believed that the opposite direction of warp in the bottom panel 24 can provide additional resistance to bending and resistance to premature separation of the sectional panels 24*a*, 24*b* along the interface 50, such as in response to a load or force applied perpendicular to the bottom panel 24. It may be noted that increasing the curvature of the curved portions $\mathbf{52}a_1$ and $\mathbf{52}b_1$ can increase the resistance to warping, i.e., increase an anti-bowing characteristic of the bottom panel 24.

It should be understood that, in some embodiments, the first and second perforated portions 52*a*, 52*b* may be formed with other configurations than are described herein. For example, in an alternate embodiment, the first and second perforated portions 52*a*, 52*b* may comprise linear perforated portions extending diagonally relative to the first and second corners $\mathbf{54}_1$, $\mathbf{54}_2$. Further, in an alternative embodiment, the size of the perforations of the curved, first sections $\mathbf{52}a_1$, $\mathbf{52}b_1$ can be the same as the perforations in the second sections $\mathbf{52}a_2$, $\mathbf{52}b_2$. In further alterative embodiments, the second sections $\mathbf{52}b_1$, $\mathbf{52}b_2$ can be provided with particular configurations for controlling the tearing resistance, including forming the second sections $\mathbf{52}b_1$, $\mathbf{52}b_2$ as continuous cut lines, multiple cut lines, i.e., a series of cut lines, a combination cut and perforated lines or a combination of different perforated lines.

Also, the release tabs 62*a*, 62 may be formed with other shapes than the T-shape described above, such as in an L-shape or other configuration. Additionally, it should be understood that reference to "concavely curved" can alternatively refer to "convexly curved," e.g., as viewed from the opposite side of the curved, first sections $\mathbf{52}a_1$, $\mathbf{52}b_1$, and the curved, first sections $\mathbf{52}a_1$, $\mathbf{52}b_1$ may be concavely curved in opposite directions from those illustrated in FIG. 1.

Figure 2:
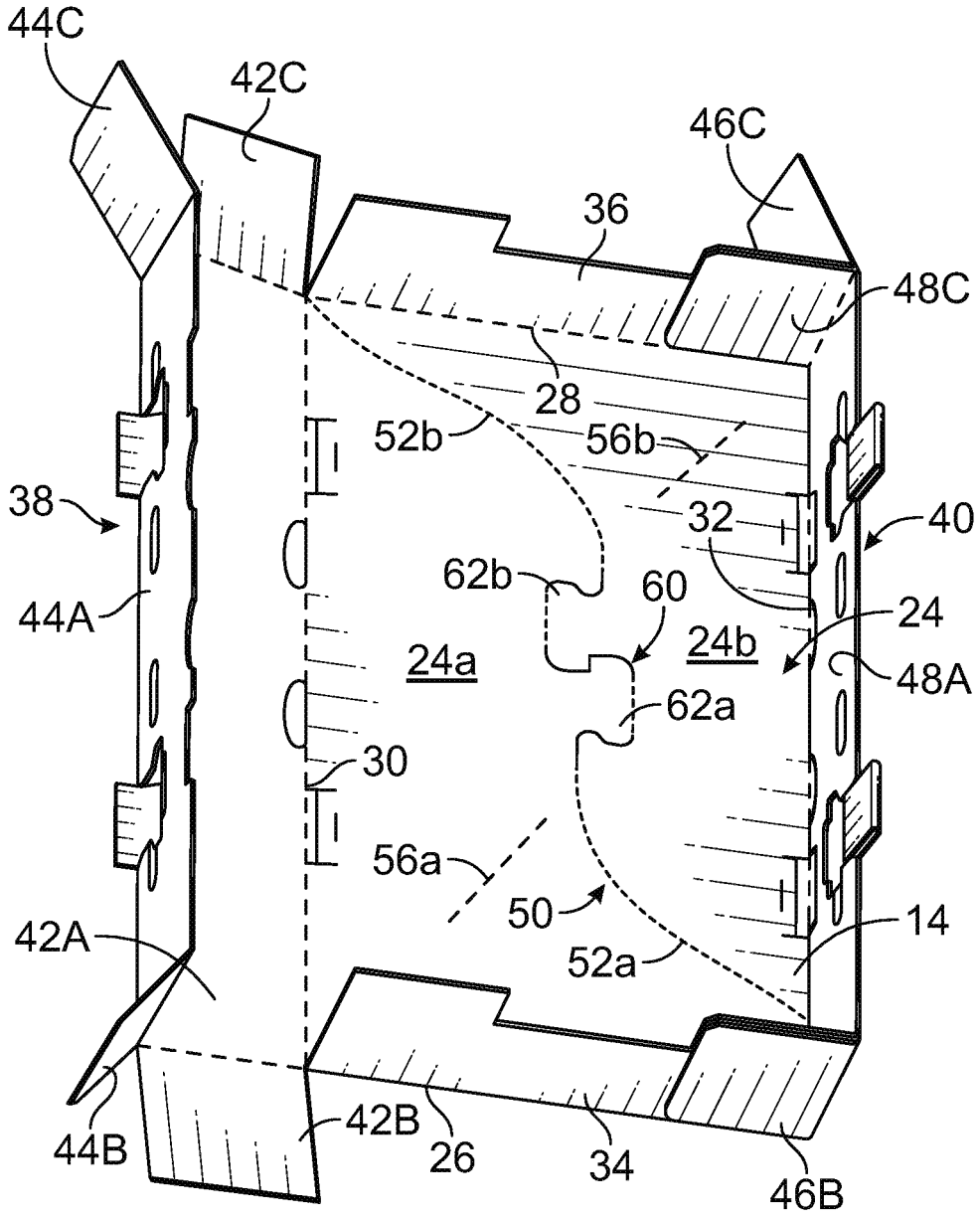
FIG. 2 is a perspective view illustrating the blank of FIG. 1 partially folded to form a container.
Figure 3:
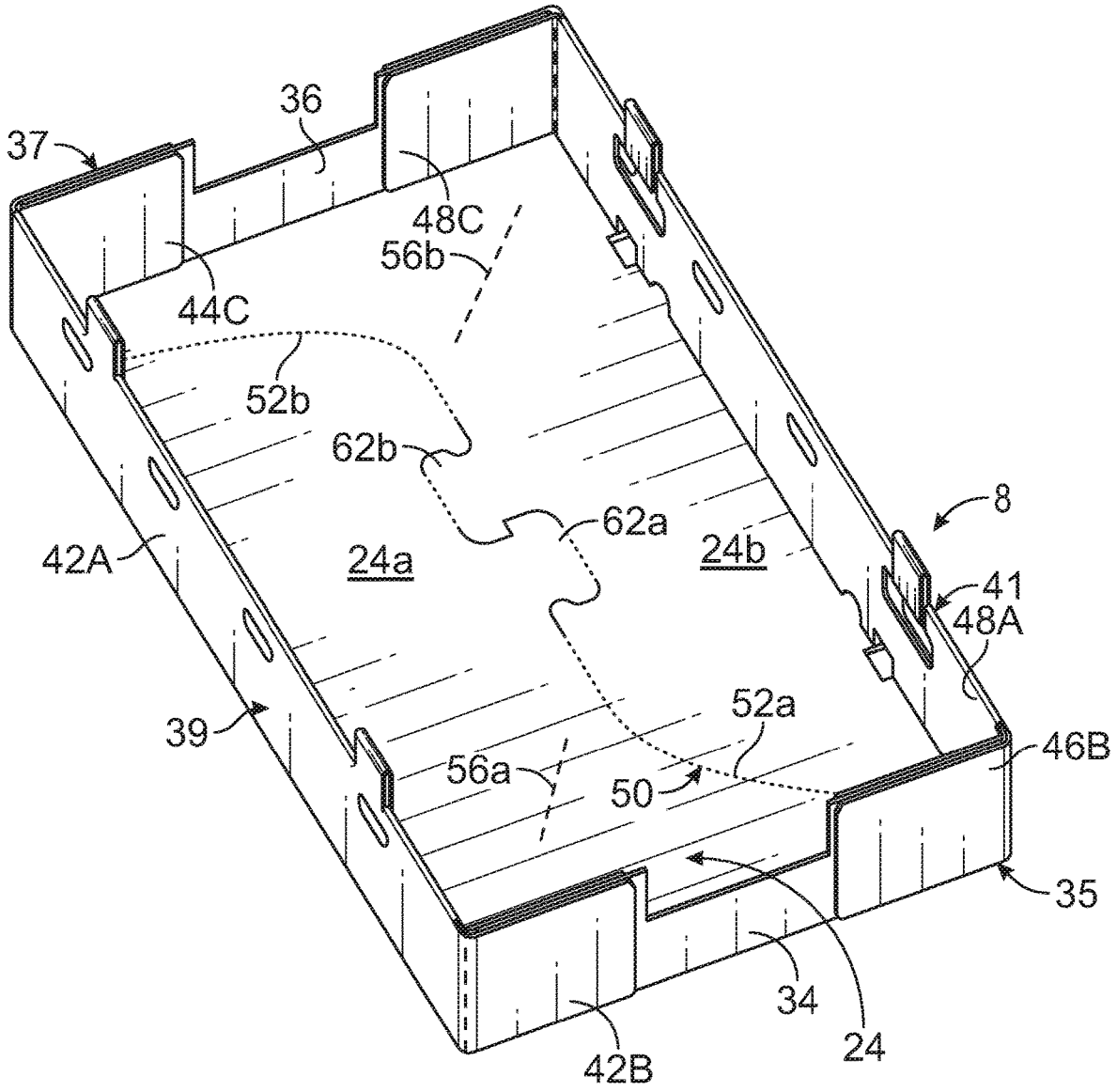
FIG. 3 is a perspective view illustrating a container formed using the blank of FIG. 1.

Referring to FIGS. 2 and 3, the blank may be used to form a container 8 incorporating the bottom panel 24 to facilitate a breakdown operation, wherein it may be understood that the present description for facilitating the breakdown operation is not limited to the particular form or configuration of container described herein. As seen in FIG. 2, a folding operation for forming the container 8 can be performed by hand or on conventional tray making machinery, and can comprise folding the end wall panels 34, 36 upward perpendicular to the bottom panel 24, and folding first and second side walls 38, 40 perpendicular to the bottom panel 24. Folding of the first and second side walls 38, 40 can comprise folding the outer side panels 42A, 46A upward perpendicular to the bottom panel 24, and folding the inner side panels 44A, 48A inwardly into overlapping relationship on an inner surface of the outer side panels 42A, 46A.

The minor inner end flaps 44B, 44C and 48B, 48C are folded perpendicular to the respective inner side panels 44A and 48A, and can be attached or adhered to inner surfaces of the end wall panels 34, 36. The minor outer end flaps 42B, 42C and 46B, 46C are folded perpendicular to the respective outer side panels 42A, 46A, and can be attached or adhered to outer surfaces of the end wall panels 34, 36. The blank 10 forms a tray 8 having side walls 39, 41 formed of two layers of material and having end walls 35, 37 and including connections with opposing ends of the end wall panels 34, 36 formed of three layers of material, see FIG. 3. Hence, the container 8 is formed as a substantially rigid structure that is resistant to collapse.

Figure 4:
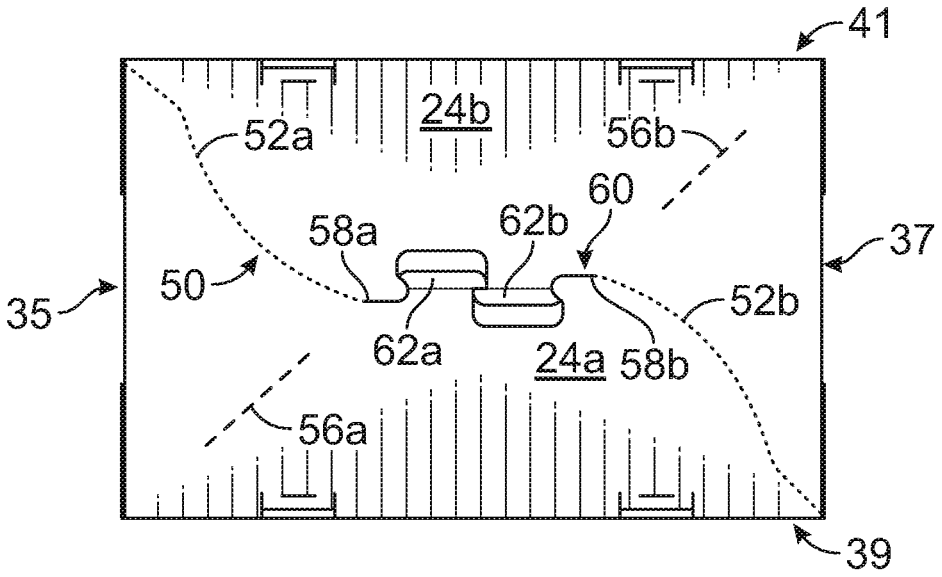
FIG. 4 is a perspective view illustrating an initial step in an operation for breaking down the container shown in FIG. 3.
Figure 5:
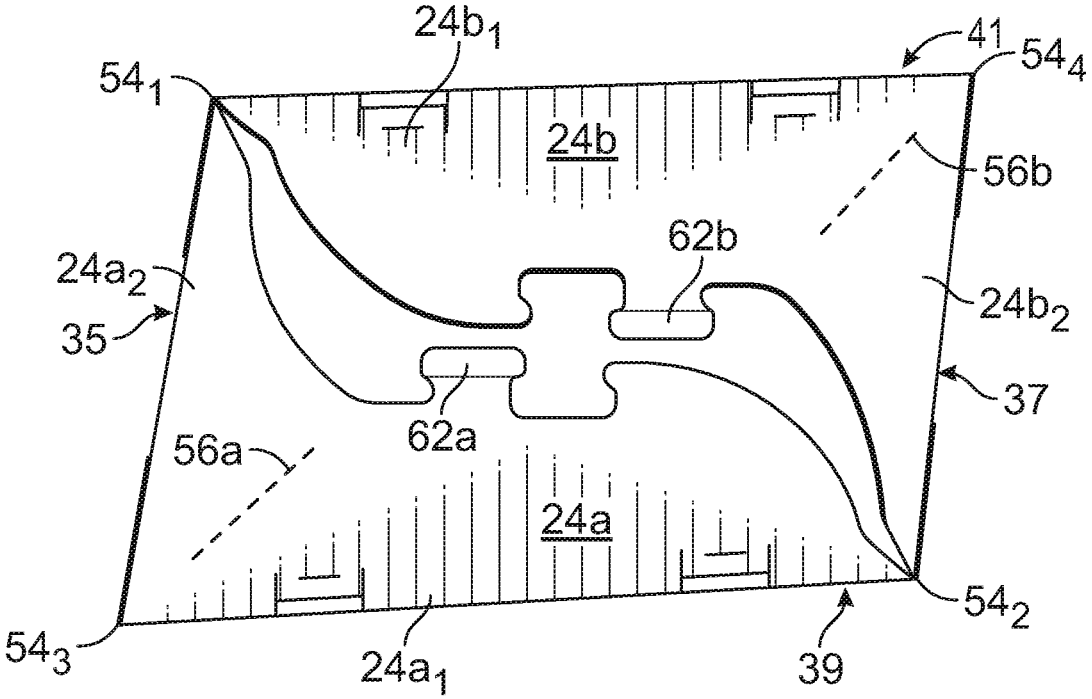
FIG. 5 is a perspective view illustrating a further step in breaking down the container of FIG. 3, including separating sectional panels of a bottom panel along an interface.
Figure 6:
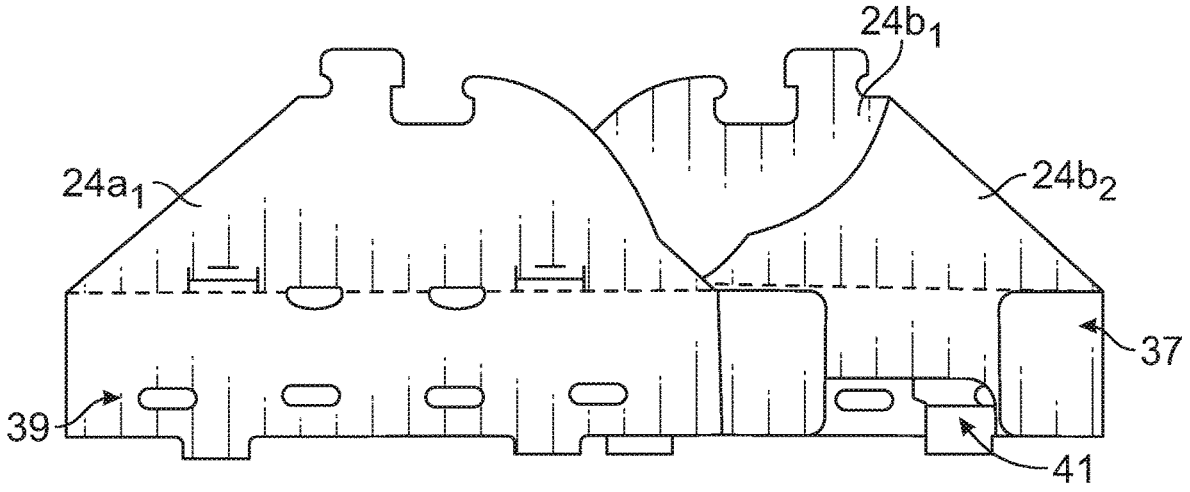
FIG. 6 is a perspective view illustrating the container of FIG. 3 in a collapsed configuration.

FIGS. 4-6 illustrate use of the described bottom panel 24 to facilitate collapse of the container 8. In an operation to break down the container 8, the release tabs 62*a*, 62*b* can initially be pivoted about the fold line 64 out of the plane of the bottom panel 24, forming finger engagement locations, i.e., a pair of openings, at the central portion 60 of the interface 50. A user can engage the central portion 60 at the openings to separate the sectional panels 24*a*, 24*b* to form a central opening generally extending the length of the central portion 60 of the interface 50 from the first inner end 58*a* to the second inner end 58*b*. Subsequently, opposing ends of the interface 50 can be separated, progressively separating the sectional panels 24*a*, 24*b* along the perforation portions 52*a*, 52*b* from the inner ends 58*a*, 58*b* toward the respective corners $\mathbf{54}_1$, $\mathbf{54}_2$, see FIG. 5.

As the sectional panels 24*a*, 24*b* are separated, the adjacent portions $\mathbf{24}a_1$, $\mathbf{24}a_2$ and $\mathbf{24}b_1$, $\mathbf{24}b_2$ of the first and second sectional panels 24*a*, 24*b* can begin to fold toward each other about the respective first and second fold lines 56*a*, 56*b*. It may be noted that once the breakdown operation is initiated to collapse the container 8, the unbroken flutes F in the areas adjacent to the fold lines 56*a*, 56*b* can bend along the lines defined by the fold lines 56*a*, 56*b*. Simultaneously with the folding of the adjacent portions $\mathbf{24}a_1$, $\mathbf{24}a_2$ and $\mathbf{24}b_1$, $\mathbf{24}b_2$, the side walls 39, 41 pivot relative to the end walls 35, 37 to collapse the bottom panel 24, the end walls 35, 37, and the side walls 39, 41 to a flattened or substantially planar configuration, as illustrated in FIG. 6.

Figure 7:
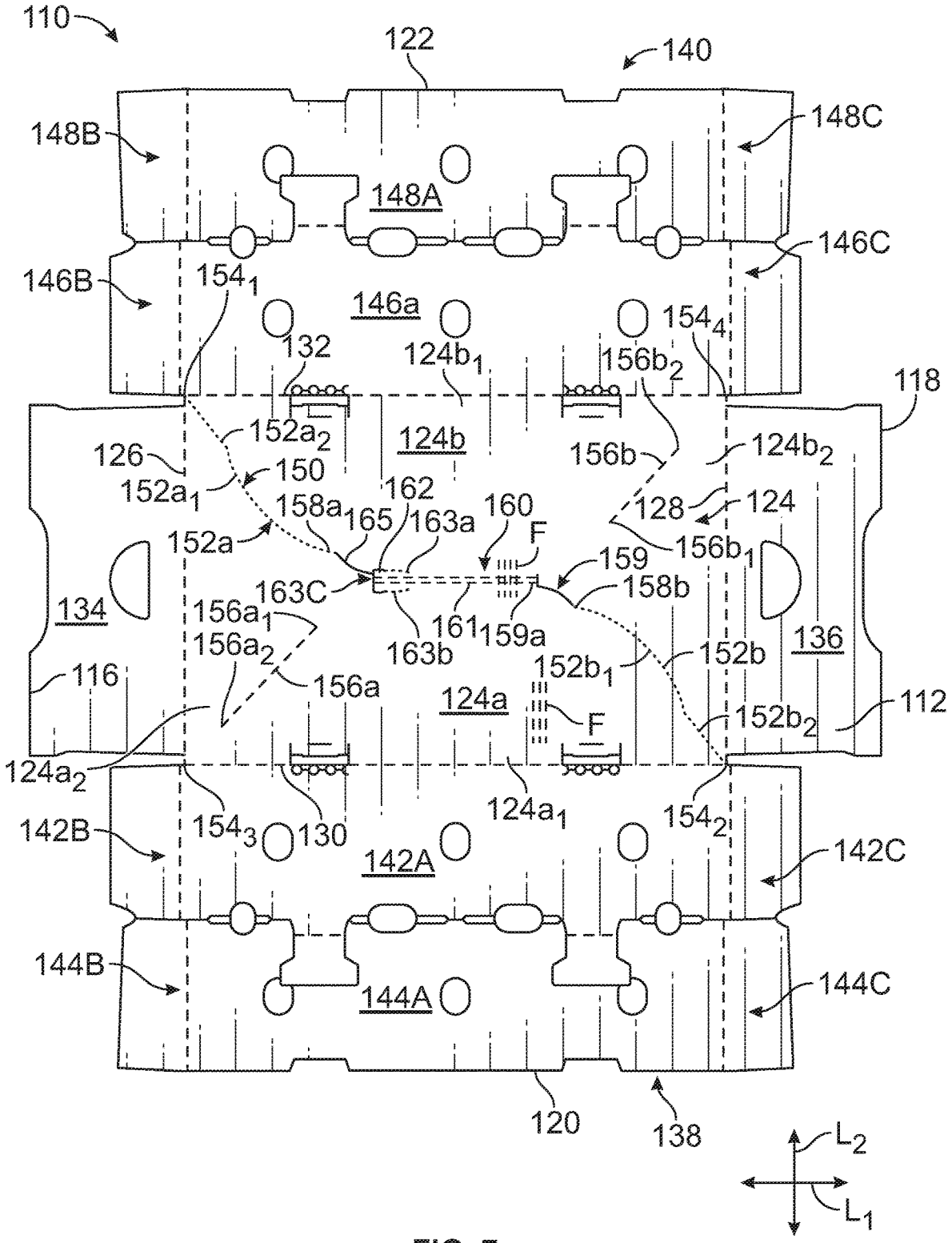
FIG. 7 is a plan view of a blank illustrating an alternative breakdown feature for collapsing a container.

Referring to FIG. 7, an alternative die cut blank 110 is shown for illustrating one or more aspects of a container or tray comprising alternative breakdown features for facilitating converting a container or tray from an erected configuration to a collapsed configuration, as described herein. Elements of the die cut blank 110 corresponding to the die cut blank 10 of FIG. 1 are labeled with the same reference numeral increased by 100. The blank 110 illustrated herein can be used to form a tray 108 generally corresponding to the tray 8 described and illustrated in FIG. 2, with the exception of alternative breakdown features provided in a bottom panel of the blank 110, as is described in further detail below. It may be understood that the described breakdown features can be incorporated in other forms of containers including, but not limited to, bliss containers or other containers configured to be resistant to collapse.

The blank 110 may be formed of a corrugated cardboard material having an interior portion defined by elongated flutes, generally designated F in FIG. 7, as is generally known in the art, and may be die cut to the shape shown herein, although other materials and variations of the illustrated shape may be provided within the scope of the container described herein. The blank 110 illustrated in FIG. 1 is a planar piece of material in which an outer side 112 is shown facing out of the page.

As seen in FIG. 7, the blank 110 extends in a longitudinal direction $L_1$ between first and second longitudinal ends, generally designated 116 and 118, respectively, and further extends in a lateral direction $L_2$, perpendicular to the longitudinal direction $L_1$, between first and second lateral edges, generally designated 120 and 122, respectively. It may be noted that the flutes F extend in the lateral direction $L_2$.

The blank 110 comprises a bottom panel 124 having a generally rectangular shape including opposing longitudinal edges 126, 128, and opposing lateral edges 130, 132. First and second end wall panels 134, 136 are hingedly connected to the respective longitudinal edges 126, 128, and first and second side walls 138, 140 are connected to the respective lateral edges 130, 132. The first side wall 138 comprises an outer side panel 142A hingedly connected to the lateral edge 130 and an inner side panel 144A hingedly connected to the outer side panel 142A. Similarly, the second side wall 140 comprises an outer side panel 146A hingedly connected to the lateral edge 132 and an inner side panel 148A hingedly connected to the outer side panel 146A. Minor outer end flaps 142B, 142C and 146B, 146C are hingedly attached to respective outer side panels 142*a* and 146A, and minor inner end flaps 144B, 144C and 148B, 148C are hingedly attached to respective inner side panels 144A and 148A.

The bottom panel 124 is formed with features that facilitate reconfiguring an erected container formed from the blank 110 into a collapsed configuration. As seen in FIG. 7, the bottom panel 124 is divided into first and second sectional panels 124*a*, 124*b* on opposing sides of an interface 150 comprising first and second perforated portions 152*a*, 152*b* generally diagonally aligned with, or at least partially defining, a diagonal, i.e., a diagonal line, across the bottom panel 124 between a first pair of diagonally opposing first and second corners $\mathbf{154}_1$, $\mathbf{154}_2$ of the bottom panel 124.

First and second fold lines 156*a*, 156*b* are generally diagonally aligned with a line across the bottom panel 124 between a second pair of diagonally opposing third and fourth corners $\mathbf{154}_3$, $\mathbf{154}_4$ of the bottom panel 124, and can extend at least partially between the second pair of diagonally opposing third and fourth corners $\mathbf{154}_3$, $\mathbf{154}_4$ of the bottom panel 124 and respective perforated portions 152*a*, 152*b*. In particular, the first fold line 156*a* includes an inner end $\mathbf{156}a_1$ that is spaced from the first perforated portion 152*a*, and includes an outer end $\mathbf{156}a_2$ that is spaced from the third corner $\mathbf{154}_3$. Similarly, the second fold line 156*b* includes an inner end $\mathbf{156}b_1$ that is spaced from the second perforated portion 152*b*, and includes an outer end $\mathbf{156}b_2$ that is spaced from the fourth corner $\mathbf{154}_4$. The first and second fold lines 156*a*, 156*b* can be defined by respective score lines formed in the material of the bottom panel 124 and forming non-separable, foldable connections between adjacent portions $\mathbf{124}a_1$, $\mathbf{124}a_2$ and $\mathbf{124}b_1$, $\mathbf{124}b_2$ of the first and second sectional panels 124*a*, 124*b*.

It should be noted that areas in the bottom panel 124 defined between the ends of the fold lines 156*a*, 156*b* and the respective perforated portions 152*a*, 152*b* and corners $\mathbf{154}_3$, $\mathbf{154}_4$ comprise areas of the bottom panel 124 with unbroken flutes F, i.e., uncrushed and/or uncut flutes, that can facilitate maintaining the strength of the bottom panel 124 to resist sagging during use of the container 8.

The first and second perforated portions 152*a*, 152*b* are configured with features that can increase resistance to separation of the interface 150 between the first and second inner ends 158*a*, 158*b* of the perforated portions 152*a*, 152*b* and the respective corners $\mathbf{154}_4$, $\mathbf{154}_3$. The first perforated portion 152*a* comprises a curved, first section $\mathbf{152}a_1$, defining a first curved portion, extending from the first inner end 158*a*, and a second section $\mathbf{152}a_2$ extending from the first section $\mathbf{152}a_1$ to the first corner $\mathbf{154}_1$, wherein the second section $\mathbf{152}a_2$ may have a different configuration from the first section $\mathbf{152}a_1$ and can be substantially straight relative to the first section $\mathbf{152}a_1$. For example, the second section $\mathbf{152}a_2$ can be defined by a straight line, a substantially straight line, or a curve, such as a curve having a direction of concavity opposite from or in the same direction as first section $\mathbf{152}a_1$. In some configurations, the second section $\mathbf{152}a_2$ can comprise a perforated section. The second section $\mathbf{152}a_2$ can bisect or generally bisect the first corner $\mathbf{154}_1$ and can include perforations that are larger than the perforations of the first section $\mathbf{152}a_1$ to facilitate separation of the sectional panels 124*a*, 124*b* as separation progresses from the first section 152$a_1$ to the second section 152$a_2$.

The second perforated portion 152*b* comprises a curved, first section 152$b_1$, defining a second curved portion, extending from the second inner end 158*b*, and a second section 152$b_2$ extending from the first section 152$b_1$ to the second corner 154$_2$, wherein the second section 152$b_2$ may have a different configuration from the first section 152$b_1$ can be substantially straight relative to the first section 152$b_1$. For example, the second section 152$b_2$ can be defined by a straight line, a substantially straight line, or a curve, such as a curve having a direction of concavity opposite from or in the same direction as the first section 152$b_1$. In some configurations, the second section 152$b_2$ can comprise a perforated section. The second section 152$b_2$ can bisect or generally bisect the second corner 154$_2$ and can include perforations that are larger than the perforations of the first section 152$b_1$ to facilitate separation of the sectional panels 124*a*, 124*b* as separation progresses from the first section 152$a_1$ to the second section 152$a_2$.

The first and second curved portions 152$a_1$, 152$b_1$ are concavely curved in opposite directions relative to a diagonal line (not shown) extending between the first pair of diagonally opposing corners, i.e., between the first corner 154$_1$ and the second corner 154$_2$. In particular, the first and second curved portions 152$a_1$ and 152$b_1$ are concavely curved toward the respective lateral edges 122, 120. The oppositely curved portions 152$a_1$ and 152$b_1$ form an opposite warp to the bottom panel 124, such that the bottom panel 124 tends to bend or warp in opposite directions in the areas adjacent to the curved portions 152$a_1$ and 152$b_1$. It is believed that the opposite direction of warp in the bottom panel 124 can provide additional resistance to bending and resistance to premature separation of the sectional panels 124*a*, 124*b* along the interface 150, such as in response to a load or force applied perpendicular to the bottom panel 124. It may be noted that increasing the curvature of the curved portions 152$a_1$ and 152$b_1$ can increase the resistance to warping, i.e., increase an anti-bowing characteristic of the bottom panel 124.

It should be understood that, in some embodiments, the first and second perforated portions 152*a*, 152*b* may be formed with other configurations than are described herein. For example, in an alternate embodiment, the first and second perforated portions 152*a*, 152*b* may comprise linear perforated portions extending diagonally relative to the first and second corners 154$_1$, 154$_2$. Further, in an alternative embodiment, the perforations of the curved, first sections 152$a_1$, 152$b_1$ can be the same as the perforations in the straight, second sections 152$a_2$, 152$b_2$. In further alterative embodiments, the second sections 152$b_1$, 152$b_2$ can be provided with particular configurations for controlling the tearing resistance, including forming the second sections 152$b_1$, 152$b_2$ as continuous cut lines, multiple cut lines, i.e., a series of cut lines, a combination cut and perforated lines or a combination of different perforated lines.

Additionally, it should be understood that reference to "concavely curved" can alternatively refer to "convexly curved," e.g., as viewed from the opposite side of the curved, first sections 152$a_1$, 152$b_1$, and the curved, first sections 152$a_1$, 152$b_1$ may be concavely curved in opposite directions from those illustrated in FIG. 7.

In accordance with an aspect of the present embodiment, a substantially continuous central portion 160 of the interface 150 extends between the first and second inner ends 158*a* and 158*b*, and can provide a continuous material connection between the spaced first and second inner ends 158*a*, 158*b* for connecting the first and second sectional portions 124*a*, 124*b*. Further, a breakdown feature comprising at least one release tab 162 can be provided at the central portion 160 for facilitating breakdown of a container 108 formed by the blank 110, see FIG. 8. The release tab 162 can be associated with a frangible feature, such as a tear strip 161 extending longitudinally along the central portion 160, wherein the tear strip 161 may be located on an inner surface of the bottom panel 124. For example, the release tab 162 can be located adjacent to an inner end 158*a*, and can be connected to the tear strip 161 extending in the longitudinal direction $L_1$ along the length of the central portion 160 to a location adjacent to the opposite inner end 158*b*.

It may be understood that a plurality of unbroken flutes F of the corrugated material extend laterally across the central portion 160 of the interface 150, wherein the plurality of unbroken flutes F comprises an area that extends substantially an entire longitudinal length of the central portion 160 of the interface 150 between the inner ends 158*a*, 158*b* of the perforated portions 152*a*, 152*b*. The present configuration for the blank 110, comprising a plurality of unbroken flutes F, i.e., uncrushed and uncut flutes, that extend laterally across the interface 150 between the first and second sectional panels 124*a*, 124*b*, can facilitate maintaining strength in the bottom panel 124 to resist sagging at the interface 150 as well as resist premature separation of the sectional panels 124*a*, 124*b* at the interface 150.

The release tab 162 may be defined by perforations 163*a*, 163*b* extending along and defining sides of the release tab 162, and an end slit 163*c* extending between the perforations 163*a*, 163*b* to define an end of the release tab 162. A further slit 165 can extend between the end slit 163*c* and the first inner end 158*a*, wherein the slit 165 is formed with a curvature that is concave in the direction of the curvature of the curved, first section 152$a_1$ of the first perforated portion 152*a*, although it may be understood that other forms and/or shapes of the slit 165 may be provided. Additionally, a terminal slit 159 can extend between the second inner end 158*b* and an end of the tear strip 161, where an end portion 159*a* of the terminal slit 159 extends perpendicular to the tear strip 161.

Figure 8:
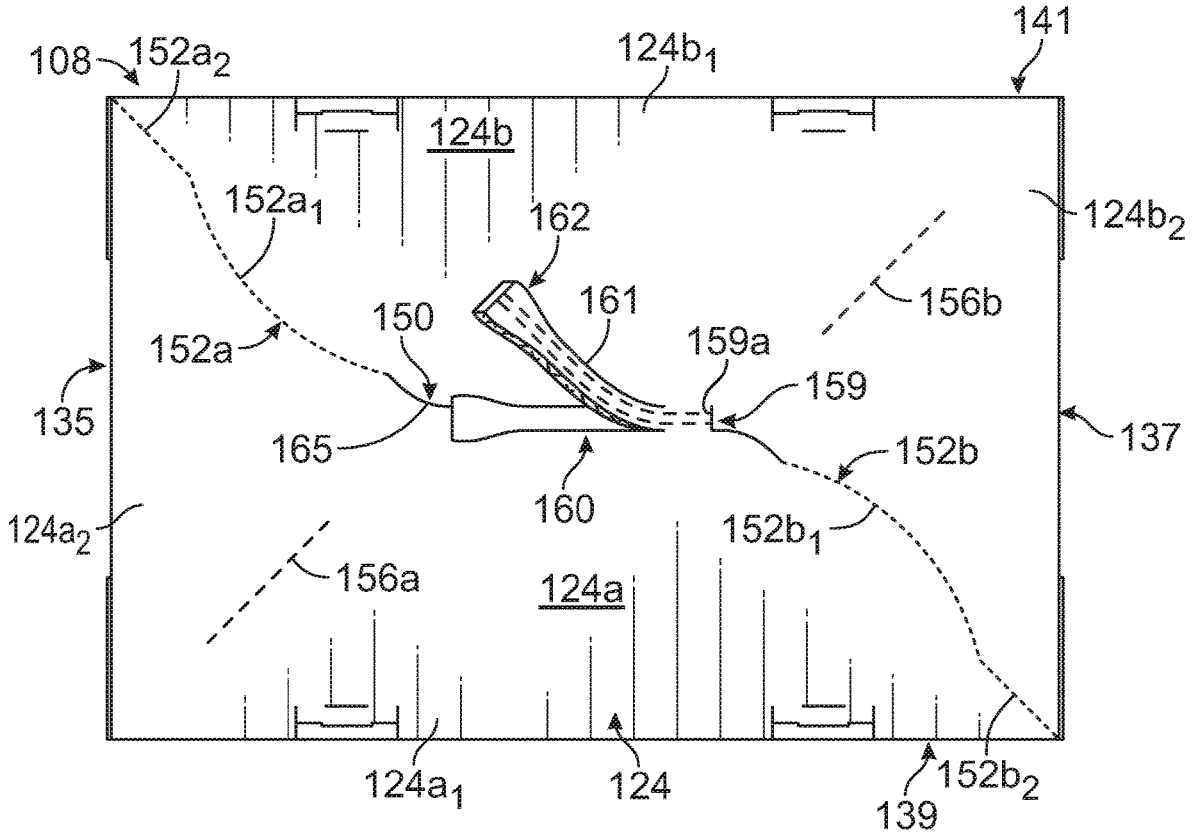
FIG. 8 is a perspective view illustrating operation of the breakdown feature on a container formed using the blank of FIG. 7

The blank 110 may be folded in a manner similar to that described for the blank 10 to form the container 108, having opposing end walls 135, 137 and opposing side walls 139, 141. Referring to FIG. 8, an operation to break down the container 108 comprises moving the release tab 162 of the plane of the bottom panel 124 and drawing the release tab 162 and connected tear strip 161 toward the second inner end 158*b* to tear the interface 150 and substantially separate the first and second sectional portions 124*a*, 124*b* along the length of the central portion 160 from the first inner end 158*a* to the second inner end 158*b*. Subsequently, opposing ends of the interface 150 can be separated, progressively separating the sectional panels 124*a*, 124*b* along the perforated portions 152*a*, 152*b* from the inner ends 158*a*, 158*b* toward the respective corners 154$_1$, 154$_2$. The sectional panels 124*a*, 124*b* can be folded at the first and second fold lines 156*a*, 156*b*, collapsing the bottom panel 124, the end walls 135, 137, and the side walls 139, 141 to a substantially planar configuration, in a manner similar to that described above for the container 8. It may be noted that once the breakdown operation is initiated to collapse the container 108, the unbroken flutes F in the areas adjacent to the fold lines 156*a*, 156*b* can bend along the lines defined by the fold lines 156*a*, 156*b*.

From the above description, it may be understood that a configuration for a bottom panel of a container is provided, such as is exemplified by the bottom panels 24, 124 of the respective blanks 10, 110, that is substantially resistant to tearing or separation of breakdown features during use of containers 8, 108 formed from the blanks 10, 110. However, upon a predetermined operation on a detachable feature, operable to initiate disengagement of adjacent portions of the bottom panels 24, 124, the respective containers 8, 108 can be readily collapsed to a substantially planar configuration.

Further, the described configuration for the bottom panels 24, 124 provides areas that are defined by unbroken flutes F, such as areas adjacent to and aligned with the fold lines 56*a*, 56*b*, 156*a*, 156*b* and areas extending across the central portion 60, 160 of the interface 50, 150 that are configured to bend or break, respectively, during breakdown of the container, and which can substantially resist sagging until a breakdown operation is initiated.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for making a collapsible container, the blank comprising:

a bottom panel having opposing first and second longitudinal edges and opposing first and second lateral edges transverse to the longitudinal edges;

one or more panels hingedly joined to the bottom panel at one or more of the longitudinal and lateral edges;

the bottom panel being divided into first and second sectional panels on opposing sides of an interface comprising perforated portions generally aligned with a diagonal between a first pair of diagonally opposing corners of the bottom panel;

each perforated portion including an inner end, wherein the inner ends of the perforated portions are longitudinally spaced from each other;

first and second fold lines extending diagonally at least partially between a second pair of diagonally opposing corners of the bottom panel and respective perforated portions; and first and second release tabs formed integrally with the first and second sectional panels, respectively, wherein the first release tab is defined in the second sectional panel and the second release tab is defined in the first sectional panel, wherein the first and second release tabs are located adjacent to each other between the inner ends of the perforated portions, and are located on opposing sides of the interface.

2. The blank as set forth in claim 1, wherein at least a portion of the first and second release tabs overlap in a longitudinal direction of extension of the interface.

3. The blank as set forth in claim 1, wherein the first release tab is releasably connected to the second sectional panel at a first perforated portion located distal from the interface, and the second release tab is releasably connected to the first sectional panel at a second perforated portion located distal from the interface.

4. The blank as set forth in claim 1, wherein the blank comprises corrugated cardboard including a layer defined by elongated flutes, and including a plurality of unbroken flutes extend laterally in the first and second release tabs across the interface.

5. The blank as set forth in claim 1, wherein the perforated portions comprise first and second curved perforated portions that are concavely curved in opposite directions relative to a diagonal line extending between the first pair of diagonally opposing corners.

6. The blank as set forth in claim 5, wherein the first and second curved perforated portions include an outer end that terminates spaced from a respective one of the first pair of diagonally opposing corners, and including a connecting perforated section extending between each of the first pair of diagonally opposing corners and an outer end of a respective curved perforated portion.

* * * * *